US007160114B2

(12) United States Patent
Chen et al.

(10) Patent No.: US 7,160,114 B2
(45) Date of Patent: Jan. 9, 2007

(54) MOTHERBOARD HAVING SELECTIVE AUDIO CONNECTION JACK LAYOUT

(75) Inventors: Jin-Xing Chen, Shenzhen (CN); Zhi-Hui Jiang, Shenzhen (CN)

(73) Assignees: Hong Fu Jin Precision Industry Co., Ltd. (CN); Hon Hai Precision Industry Co., Ltd. (TW)

( * ) Notice: Subject to any disclaimer, the term of this patent is extended or adjusted under 35 U.S.C. 154(b) by 0 days.

(21) Appl. No.: 11/142,074

(22) Filed: Jun. 1, 2005

(65) Prior Publication Data

US 2006/0009060 A1 Jan. 12, 2006

(30) Foreign Application Priority Data

Jul. 12, 2004 (CN) ..... 2004 2 0071677

(51) Int. Cl.
*H01R 12/00* (2006.01)

(52) U.S. Cl. ..... 439/55

(58) Field of Classification Search ..... 439/55; 710/301, 305; 361/760; 174/261
See application file for complete search history.

(56) References Cited

U.S. PATENT DOCUMENTS

| | | | | |
|---|---|---|---|---|
| 5,064,378 | A * | 11/1991 | Olson et al. | 439/68 |
| 5,751,557 | A * | 5/1998 | Silva | 361/777 |
| 5,788,511 | A * | 8/1998 | Burnworth et al. | 439/63 |
| 6,438,637 | B1 * | 8/2002 | Chen | 710/301 |
| 6,612,850 | B1 * | 9/2003 | Dai | 439/55 |
| 6,761,584 | B1 | 7/2004 | Li | |
| 2004/0037426 | A1 | 2/2004 | Chu et al. | |

* cited by examiner

*Primary Examiner*—Gary F. Paumen
(74) *Attorney, Agent, or Firm*—Morris Manning & Martin LLP

(57) ABSTRACT

A motherboard (100) in accordance with a preferred embodiment includes an audio connection area (10) defining a first jack layout (12). The first jack layout integrates second and third jack layouts for two audio connectors of different specifications, so that jacks (121, 122) of the first jack layout can selectively connect with the audio connectors.

13 Claims, 3 Drawing Sheets

MOTHERBOARD HAVING SELECTIVE AUDIO CONNECTION JACK LAYOUT

BACKGROUND OF THE INVENTION

1. Field of the Invention

The present invention relates to a motherboard that has a selective audio connection jack layout.

2. General Background

In many contemporary computer systems, a multichannel sound effect is provided as a standard feature. Support for output of a 5.1 soundtrack format has been widely used. The 5.1 soundtrack format includes six channels: a left channel, a right channel, a center channel, a left surround channel, a right surround channel, and a low-frequency-effect channel (0.1 channel). A coder/decoder (CODEC), such as ALC658 and ALC655 which comply with AC97 edition 2.3, outputs three groups of signals to a three-hole audio connector. The three-hole audio connector includes three audio connectors: LINE-OUT, LINE-IN, and MIC-IN.

In keeping with market trends toward upgrading of sound effect features, a 7.1 soundtrack format is preferable over the 5.1 soundtrack format. The 7.1 soundtrack format uses the six channels of the 5.1 soundtrack format, and further includes a rear left surround channel and a rear right surround channel. The 7.1 soundtrack format needs a CODEC that supports it, in order to produce six groups of signals output to a six-hole audio connector. CODECs that support the 7.1 soundtrack format include ALC850 which complies with AC97 edition 2.3, and ALC880 which adopts the technology of Intel Corporation's High Definition Audio (HD Audio).

Referring to FIGS. 1 and 2, a conventional motherboard 200 defines a connection area 50 for a three-hole audio connector (not shown) to be connected thereto. The connecting area 50 defines a jack layout 52. The jack layout 52 includes five mounting jacks 521 for physically connecting the three-hole audio connector thereto, and a plurality of electrical jacks 522 for transmitting signals between the motherboard 200 and the three-hole audio connector. A coder/decoder (CODEC) 70 for the 5.1 soundtrack format is electrically connected to the electrical jacks 522 via an electrical connection module 60.

Referring to FIGS. 3 and 4, a conventional motherboard 300 defines a connection area 80 for a six-hole audio connector (not shown) to be connected thereto. The connecting area 80 defines a jack layout 82. The jack layout 82 includes four mounting jacks 821 for physically connecting the six-hole audio connector thereto, and a plurality of electrical jacks 822 for transmitting signals between the motherboard 300 and the six-hole audio connector. A coder/decoder (CODEC) 72 for the 7.1 soundtrack format is electrically connected to the electrical jacks 822 via an electrical connection module 62.

Hence, for a computer system to provide a choice of the 5.1 soundtrack format and the 7.1 soundtrack format, motherboards of two different specifications have to be installed in the computer system. That is, the motherboard 200 for connecting the audio connector that supports the 5.1 soundtrack format is needed, and the motherboard 300 for connecting the audio connector that supports the 7.1 soundtrack format is also needed. As a result, production costs are unduly high.

If both the jack layouts 52, 82 are defined in the same motherboard 200 or 300, the total expanse of the audio connection area 50 or 80 must be increased. Hence, the specification of the motherboard 200 or 300 must be changed. Even worse, the specification of the associated computer enclosure may also have to be changed as a result.

What is needed is a motherboard having an audio connection jack layout that is capable of selectively connecting with different audio connectors to respectively support different sound effects.

SUMMARY

A motherboard in accordance with a preferred embodiment includes an audio connection area defining a first jack layout. The first jack layout integrates second and third jack layouts for two audio connectors of different specifications, so that jacks of the first jack layout can selectively connect with the audio connectors. At least one of the jacks of the first jack layout is common to both the second jack layout and the third jack layout. The motherboard further includes an electrical connection module attached thereto, and coder/decoder (CODEC). The electrical connection module electrically connects the jacks of the first jack layout to the CODEC.

Other objects, advantages and novel features will become more apparent from the following detailed description when taken in conjunction with the accompanying drawings, in which:

DETAILED DESCRIPTION OF THE EMBODIMENT

Figure 1:
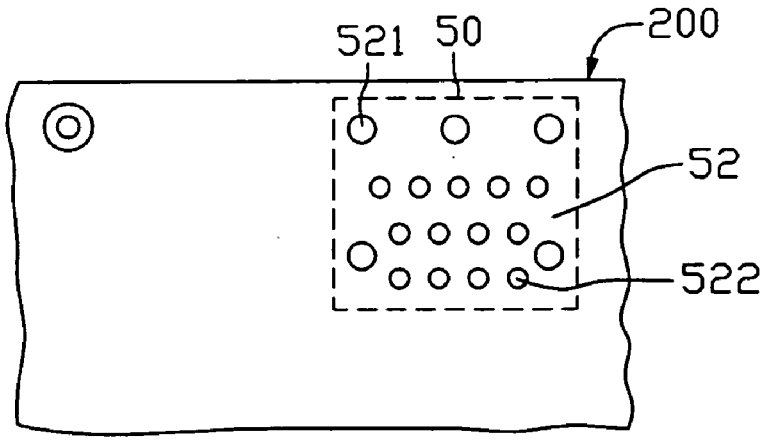
FIG. 1 (PRIOR ART)
FIG. 1 is a schematic, top plan view of a conventional motherboard that has a jack layout that supports a 5.1 soundtrack format.
Figure 2:
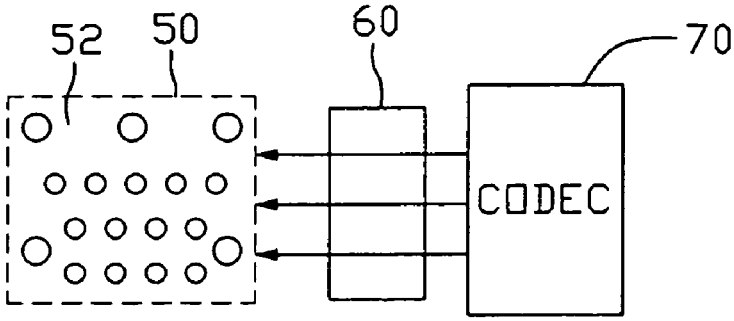
FIG. 2 (PRIOR ART)
FIG. 2 is a schematic view showing electrical connection of the jack layout of the motherboard of FIG. 1 with a CODEC via an electrical connection module.
Figure 3:
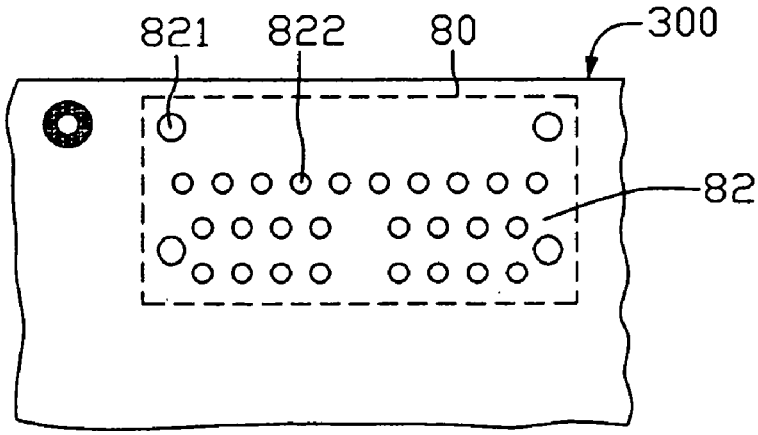
FIG. 3 (PRIOR ART)
FIG. 3 is a schematic, top plan view of a conventional motherboard that has a jack layout that supports a 7.1 soundtrack format.
Figure 4:
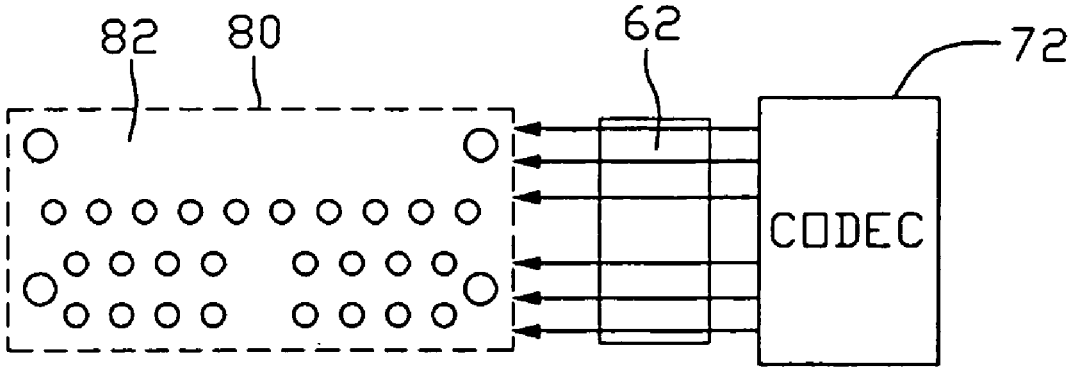
FIG. 4 (PRIOR ART)
FIG. 4 is a schematic view showing electrical connection of the jack layout of the motherboard of FIG. 3 with a CODEC via an electrical connection module.
Figure 5:
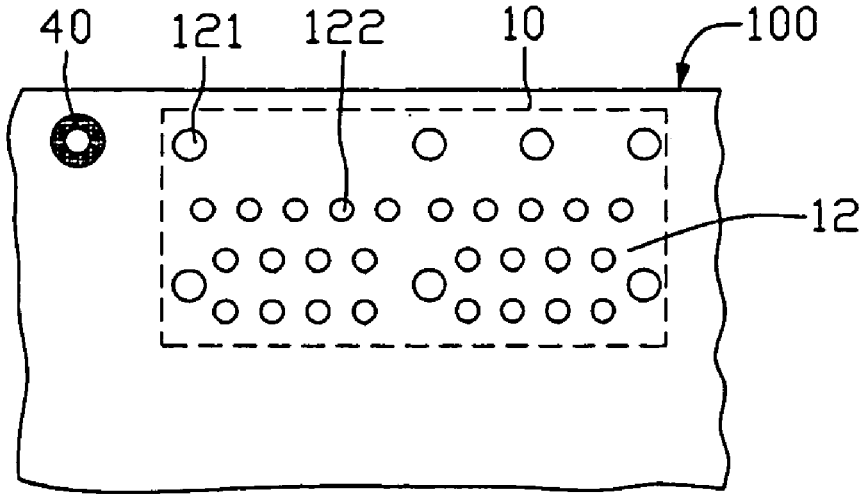
FIG. 5 is a schematic, top plan view of a motherboard that has a jack layout that selectively supports the 5.1 or the 7.1 soundtrack format, in accordance with a preferred embodiment of the present invention.
Figure 6:
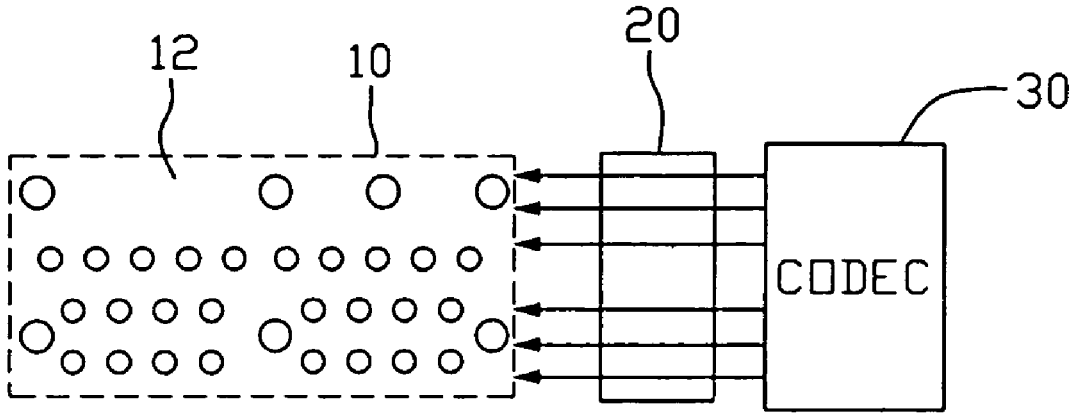
FIG. 6 is a schematic view showing electrical connection of the jack layout of the motherboard of FIG. 5 with a CODEC that supports the 7.1 soundtrack format, the connection being via an electrical connection module.
Figure 7:
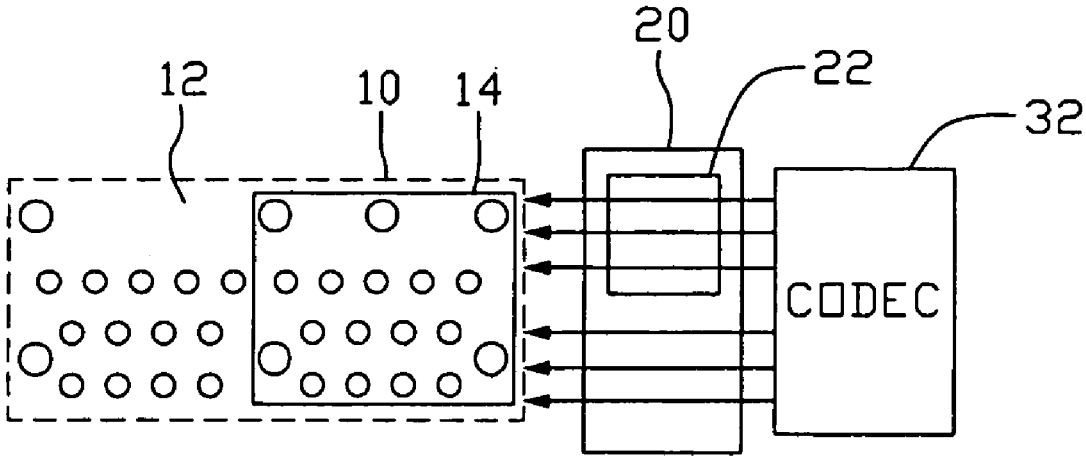
FIG. 7 is a schematic view showing electrical connection of part of the jack layout of the motherboard of FIG. 5 with a CODEC that supports the 5.1 soundtrack format, the connection being via a part of the electrical connection module of FIG. 6.

Referring to FIGS. 5–7, a motherboard 100 in accordance with a preferred embodiment of the present invention is capable of selectively connecting with components like a three-hole audio connector or a six-hole audio connector (not shown).

The motherboard 100 includes an audio connection area 10, and a screw hole 40 located at a left side of the audio connection area 10 for mounting the motherboard 100 to a computer enclosure. An electrical connection module 20 is connected to the jack layout 12.

Referring to FIG. 5, in the audio connection area 10, jack layouts for the three-hole audio connector and the six-hole audio connector cooperatively define the jack layout 12. The jack layout 12 defines seven mounting jacks 121, and a plurality of electrical jacks 122 for electrically connecting with signal pins of the three-bole audio connector and the six-hole audio connector, respectively. Four of the mounting jacks 121 located at four cowers of the audio connection area 10 are adapted for physically connecting with terminals of a six-hole audio connector so as to position and mount the six-hole audio connector to the motherboard 100. Referring to FIG. 7, five of the mounting jacks 121 and a proportion of the electrical jacks 122 cooperatively define ajack layout 14 for the three-hole audio connector. The five mounting jacks 121 in the jack layout 14 are adapted for physically connecting with terminals of the three-hole audio connector so as to position and mount the three-hole audio connector to the motherboard 100. Referring to FIGS. 6 and 7, hence, only one motherboard or motherboard specification is needed. The electrical connection module 20 is attached to the motherboard 100 to connect the jack layout 12 or 14 with a corresponding coder/decoder (CODEC) 30 or 32. Referring to FIG. 6, when a 7.1 soundtrack format is selected, the six-hole audio connector is connected to the jack layout 12, and the CODEC 30 for the 7.1 soundtrack format is electrically connected to the electrical jacks 122 of the jack layout 12 via the electrical connection module 20. Referring to FIG. 7, when a 5.1 soundtrack format is selected, the three-hole audio connector is connected to the jack layout 14, and the CODEC 32 for the 5.1 soundtrack format is electrically connected to the electrical jacks 122 of the jack layout 14 via one part 22 of the electrical connection module 20.

The present invention addresses the characteristics of both the three-hole audio connector and the six-hole audio connector. The jack layout for the three-hole audio connector is arranged integrally with the jack layout for the six-hole audio connector. This enables manufacturers or users to selectively connect two different audio connectors according to individual requirements. In particular, manufacturers need only produce one type of motherboard to support both the 5.1 soundtrack format and the 7.1 soundtrack format. Accordingly, production costs may be greatly reduced.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment.

We claim:

1. A motherboard comprising an audio connection area defining a first jack layout, wherein the first jack layout integrates second and third jack layouts for two audio connectors of different specifications, so that jacks of the first jack layout can selectively connect with the audio connectors, wherein the second jack layout is entirely located within an area of the third jack layout, and wherein the first jack layout comprises a plurality of mounting jacks used for mounting and a plurality of electrical jacks used for signal connection, electrical jacks of the third jack layout include all of the electrical jacks of the first jack layout, electrical jacks of the second jack layout include some of the electrical jacks of the first jack layout, and at least one of the mounting jacks of the first jack layout is common to both the second jack layout and the third jack layout.

2. The motherboard as claimed in claim 1, wherein the second jack layout is for a three-hole audio connector, and the third jack layout for a six-hole audio connector.

3. The motherboard as claimed in claim 2, wherein the three-hole audio connector is used for a 5.1 soundtrack format, and the six-hole audio connector is used for a 7.1 soundtrack format.

4. The motherboard as claimed in claim 1, further comprising an electrical connection module attached thereto and a coder/decoder (CODEC), the electrical connection module electrically connecting jacks of the first jack layout to the CODEC.

5. The motherboard as claimed in claim 4, wherein the electrical connection module is compatible with 5.1 and 7.1 soundtrack format electrical connections, and the CODEC supports 5.1 and 7.1 soundtrack formats.

6. The motherboard as claimed in claim 1, wherein the motherboard defines a screw hole beside the audio connection area, for securing the motherboard to a computer.

7. A motherboard comprising:

a first jack layout which combines second and third jack layouts, the second and third jack layouts being compatible with selected of two audio connectors having different specifications;

a coder/decoder (CODEC); and an electrical connecting module connecting the CODEC to the first jack layout;

wherein an area of the first jack layout is substantially equal to an area of a larger one of the second and third jack layouts, and wherein the first jack layout comprises a plurality of mounting jacks used for mounting and a plurality of electrical jacks used for signal connection, electrical jacks of the third jack layout include all of the electrical jacks of the first jack layout, electrical jacks of the second jack layout include some of the electrical jacks of the first jack layout, and at least one of the mounting jacks of the first jack layout is common to both the second jack layout and the third jack layout.

8. The motherboard as claimed in claim 7, wherein the second and third jack layouts comprise a jack layout compatible with a three-hole audio connector and a jack layout compatible with a six-hole audio connector.

9. The motherboard as claimed in claim 8, wherein the three-hole audio connector is used for a 5.1 soundtrack format, and the six-hole audio connector is used for a 7.1 soundtrack format.

10. The motherboard as claimed in claim 8, wherein the electrical connection module is compatible with 5.1 and 7.1 soundtrack format electrical connections, and the CODEC supports 5.1 and 7.1 soundtrack formats.

11. A method for using a motherboard having a layout compatible with at least two different components and electrically connectable therewith, comprising the steps of:

defining a plurality of mounting jacks of said layout used for mounting at least two different components on said motherboard;

defining a plurality of electrical jacks of said layout used for signal connection with said at least two different components on said motherboard beside said plurality of mounting jacks;

mounting a selective one of said at least two different components onto said motherboard by using at least one common mounting jack necessarily available for mounting another one of said at least two different components; and electrically connecting said selective one of said at least two different components with said motherboard by using at least one common electrical jack necessarily available for mounting said another one of said at least two different components.

12. The method as claimed in claim 11, wherein said at least two different components comprise a three-hole audio connector and a six-hole audio connector.

13. The method as claimed in claim 11, wherein an area that said plurality of mounting jacks and electrical jacks occupy is equal to an area that a corresponding layout of a largest one of said at least two different components occupies.

* * * * *